US009764192B1

(12) United States Patent
Maresh

(10) Patent No.: US 9,764,192 B1
(45) Date of Patent: Sep. 19, 2017

(54) SWIM FIN

(71) Applicant: Joseph D Maresh, West Linn, OR (US)

(72) Inventor: Joseph D Maresh, West Linn, OR (US)

( * ) Notice: Subject to any disclaimer, the term of this patent is extended or adjusted under 35 U.S.C. 154(b) by 0 days.

(21) Appl. No.: 15/098,302

(22) Filed: Apr. 13, 2016

Related U.S. Application Data

(60) Provisional application No. 62/178,546, filed on Apr. 13, 2015, provisional application No. 62/231,259, filed on Jun. 29, 2015, provisional application No. 62/231,696, filed on Jul. 13, 2015, provisional application No. 62/282,187, filed on Jul. 27, 2015.

(51) Int. Cl.
*A63B 31/08* (2006.01)
*A63B 31/11* (2006.01)

(52) U.S. Cl.
CPC ..... *A63B 31/11* (2013.01)

(58) Field of Classification Search
CPC ..... A63B 31/11
See application file for complete search history.

(56) References Cited

U.S. PATENT DOCUMENTS 7,281,963 B1 * 10/2007 Feng ..... A63B 31/11 441/64
2003/0144071 A1 * 7/2003 Dodge ..... A43B 13/026 473/316
2006/0025027 A1 * 2/2006 Chen ..... A63B 31/14 441/61
2010/0273371 A1 * 10/2010 Hsu ..... A63B 31/11 441/64

* cited by examiner

*Primary Examiner* — Stephen Avila
(74) *Attorney, Agent, or Firm* — Nick A Nichols, Jr.

(57) ABSTRACT

A swim fin and a method proving thrust propulsion during a swimmer's kicking cycle may include a foot pocket and a fin blade extending from the foot pocket. Fin rails may extend along the lateral edges of the fin blade. The fin rails may include an integral fin spine or separately assembled fin spine configured to provide a swim fin with predetermined hydrodynamic characteristics.

15 Claims, 12 Drawing Sheets

818
800
824
822
820
812
814
810
824
822
820
812
814
810

812
820
826
822
824

1000
1016
1024
1014
1018
1012
1026
1020

1024
1014
1012
1016
1026
1018

1012
1014
1018
1016
1024
1022
1020

1012
1014
1026
1024
1020
1016
1022

1026
1012
1024
1018
1014
1020

SWIM FIN

CROSS-REFERENCE TO RELATED APPLICATION

This application claims the benefit of U.S. Provisional Application Ser. No. 62/178,546, filed Apr. 13, 2015, U.S. Provisional Application Ser. No. 62/231,259, filed Jun. 29, 2015, U.S. Provisional Application Ser. No. 62/231,696, filed Jul. 13, 2015, and U.S. Provisional Application Ser. No. 62/282,187, filed Jul. 27, 2015, which applications are incorporated herein by reference in their entireties.

BACKGROUND

The present invention relates to hydrofoils of the type used for propulsion in a fluid medium, and more particularly to swim fins.

Swim fins are used by swimmers, body surfers, divers and others in water to improve propulsion speed and water agility. Swim fin designs that combine a foot pocket with side rails and a propulsion blade are commercially available. The objective of a swim fin design is to provide maximum propulsion and agility while minimizing the work expended by the swimmer. This may be accomplished by optimizing the angle of attack of the fin blade during the up and down strokes of the swimmer's kick propelling him through the water. Typical swim fins currently available are either too rigid or too flexible for a given use, or have contours or profiles that result in inefficient hydrodynamics where water spills over the sides of the fin blade, or generate fluid vortices that may negate lift or propulsive forces resulting in a decrease in swimming efficiency with a corresponding increase in swimmer fatigue. For optimum propulsion it is desired for water flow to be laminar and essentially free of excess turbulence.

The "angle of attack" of a fin blade may be defined as the angle between the line of horizontal movement of the swimmer's body through the water and the lengthwise alignment of the fin blade relative to the line of horizontal movement. Swim fin performance may be optimized for various modes of use. For example, available swim fins may be designed for low, moderate or aggressive kicking. For recreational or relaxed use, the swim fin may be constructed of flexible material to provide a low angle of attack for efficient low thrust operation. For aggressive kicking, the swim fin may be constructed of stiff material to provide a high angle of attack for efficient high thrust operation. A proper angle of attack may optimize the conversion of kicking energy of the swimmer to thrust or propulsion through the water. Aggressive and nonaggressive modes of use generally required different fin designs and/or different fin material durometers because optimum fin performance for each mode requires mutually exclusive design parameters. During nonaggressive use a highly flexible fin blade may provide efficient low thrust operation, whereas during aggressive use a rigid fin blade may provide efficient high thrust operation. Other known swim fin designs provide deformable regions permitting the fin blade to flex about a transverse axis.

SUMMARY

A swim fin may include a foot pocket configured to receive a foot of a swimmer and a fin blade extending from the foot pocket. The fin blade may be relatively stiff and flex about a hinge region proximate the foot pocket. Fin rails may extend along the lateral edges of the fin blade. The fin rails may include an integral fin spine configured to provide a swim fin with predetermined hydrodynamic characteristics. The fin blade may flex within a maximum angle of attack that may be variable and dynamically changed, within the predetermined maximum attack angle range, as a function of the kicking force generated by a swimmer during a kicking cycle.

Another aspect of the swim fin may include separately assembling the fin spines and embedding the fin spines in the fin rails during the molding process or securing the fin spines in a longitudinal cavity formed in the fin rails. The fin spines may include blocks or bushings of various sizes and shapes threaded on a cable routed through the blocks or bushings. The fin spines may be pre-tensioned to optimize the fin blade attack angle within a predetermined attack angle range.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

DETAILED DESCRIPTION

Figure 1:
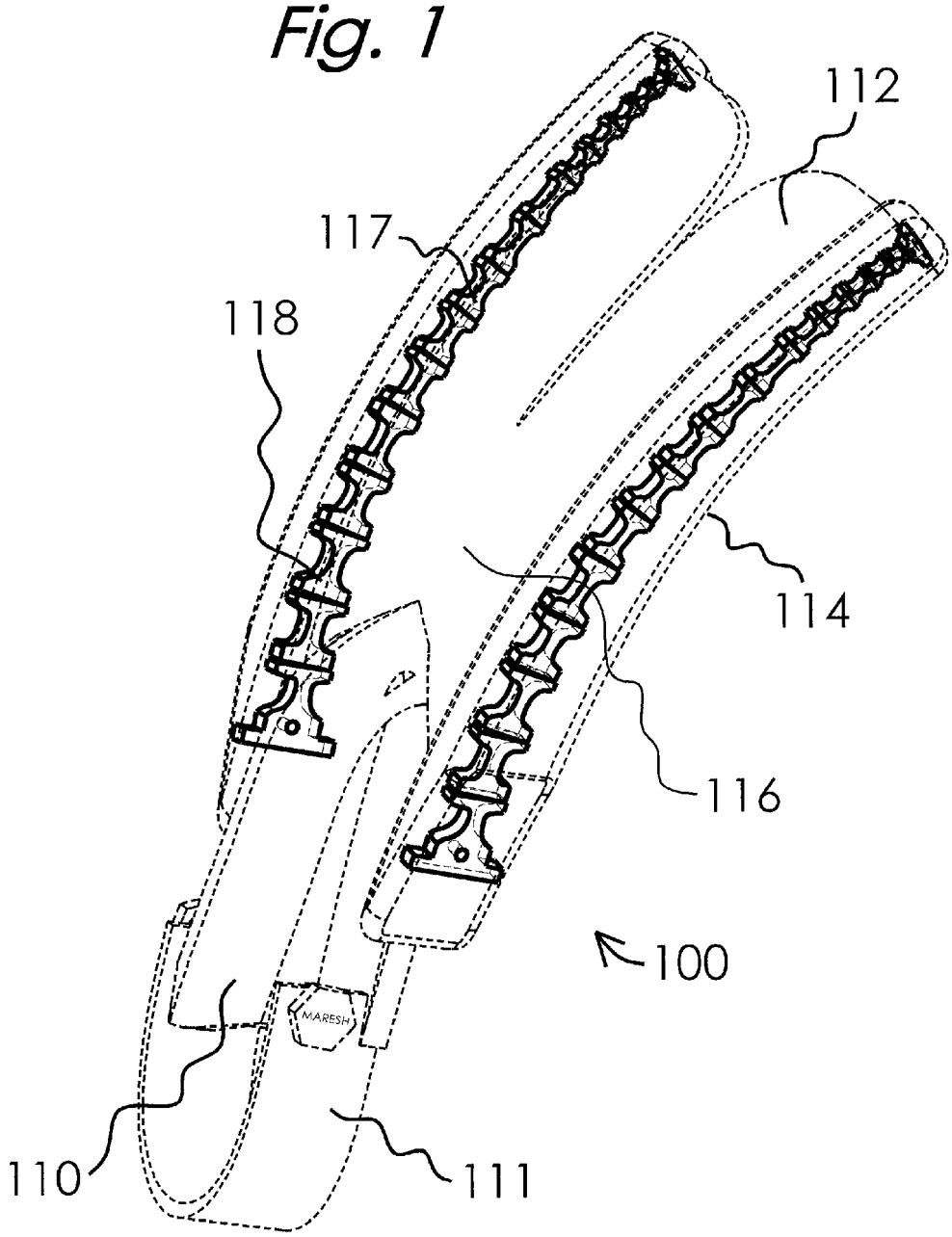
FIG. 1 is a perspective view of a swim fin.

Referring first to FIG. 1, a swim fin depicted in phantom is generally identified by the reference numeral 100. The swim fin 100 may be molded or otherwise fabricated in a manner known in the art. The swim fin 100 may be formed of flexible materials, such as rubber, thermoplastic rubber and/or other synthetic material. and/or a composite of materials including carbon fiber. The swim fin 100 may include a full boot or shoe for receiving the foot of a swimmer or an open foot pocket 110, shown in FIG. 1. A heel strap 111 may be provided to secure the foot of a swimmer in the foot pocket 110. A fin blade 112 may extend from the foot pocket 110. The fin blade 112 may include a substantially planar surface for channeling water flow across the swim fin 100. Fin rails 114 may extend along the lateral edges of the fin blade 112.

The fin blade 112 is relatively stiff. During a kicking cycle, the fin blade 112 may flex about a transverse hinge region 116 of the swim fin 100. Flexing of the fin blade 112 may be limited by a swim fin spine 117 formed by blocks 118 embedded in the fin rails 114 in a serial or linear configuration to form a column of blocks 118. The length of the column of blocks 118 may be a predetermined value. The shape of the blocks 118 is not limited to a particular shape but may, for example, be cubically shaped, chevron shaped, cylindrically shaped, and/or polygon shaped. As shown in FIG. 1, the blocks 118 may be arranged in a serial or linear manner and then molded in place within the fin rails 114 during fabrication of the swim fin 100. The size and shape of the blocks 118 may be predetermined to provide hydrodynamic characteristics that may be desired. The blocks 118 may be molded from plastic, for example but not by limitation, polycarbonate, polyetheretherketone (PEEK) and the like. Alternatively, the blocks 118 may be formed of metal. In the instance of plastic blocks, the blocks 118 may be molded either in individual cavities or multiple cavity molds, and placed individually in the swim fin 100 mold, or may be molded in a multi-cavity mold where adjacent blocks 118 are connected with flashing (unillustrated) from a parting line, space, or runner such that all blocks 118 are connected by a very thin cross section of plastic material in order to facilitate placement of the column of blocks 118 into the swim fin 100 mold. Once the swim fin 100 has been molded and cured, the swim fin 100 may be flexed to break the block 118 flashings, or alternatively, the end user swimmer may cause the block 118 flashings to break immediately and automatically upon first use of the swim fin 100. In any event, minimal force is required to break the block flashings, and although the swimmer may hear audible snaps while the flashings break, the swimmer is not likely to experience any noticeable bending resistance during such occurrence.

Continuing with FIG. 1, the design of the swim fin 100 may be optimized for a predetermined maximum angle of attack of the fin blade 112. For example, the blocks 118 may be symmetrically shaped so that the fin rails 114 and fin blade 112 flex at equal angles from a relaxed state of the swim fin 100. Alternatively, the shape of the blocks 118 may be unsymmetrical so that the predetermined angle of attack produces high thrust during a power down kick stroke, and minimal thrust during a return up kick stroke. Other factors that may be considered to optimize the swim fin design, may include whether to align the neutral axis of the fin blade 112 with the neutral axis of the fin rails 114, or whether to offset one neutral axis from the other. In this manner the progression of the fin blade 112 angle of attack profile as a function of thrust is a dynamic variable up to the predetermined attack of angle of fin blade 112.

The swim fin 100 may provide an optimum fin blade 112 angle of attack for a range of kicking strokes. The overall flexibility of the swim fin 100 permits a low angle of attack of the fin blade 112 during relaxed or moderate kicking, while during hard aggressive kicking the fin blade 112 may bend at a greater angle of attack, for example forty-five (45°) degrees from a horizontal relaxed state, as an increase of water flow across the swim fin 100 exerts increased fluid pressure against the surface of the fin blade 112. The angle of attack curve profile of the fin blade 112 is asymptotically limited by the column of blocks 118 in the fin rails 114 to the maximum predetermined angle of attack to ensure efficient thrust propulsion with maximum laminar water flow across the swim fin 100.

The flexibility potential of the swim fin 100, with predetermined maximum fin blade attack angles, may facilitate a swimmer's rapid change of direction, particularly when agility is required, as for example, when a swimmer must contort his body during critical water diving or swimming events. Also, during moderate kicking, the swimmer may experience a reduction in ankle, foot, and Achilles tendon pain.

The torsional stiffness of the fin blade 112 is generally balanced at left and right sides of the fin blade 112 due to the bending limit constraints imposed on the fin rails 114 by the column of blocks 118. Efficiency may be gained by essentially eliminating swim fin twist as the swimmer kicks. In this manner, water flow over the surface of the fin blade 112 without spilling over may be achieved and the swim fin 100 may track straighter without twisting and steering by the swimmer, thus conserving energy. The swim fin 100 may thus provide a highly stabilized and straight line kicking experience, while enabling the swimmer to maneuver as desired.

Figure 2A:
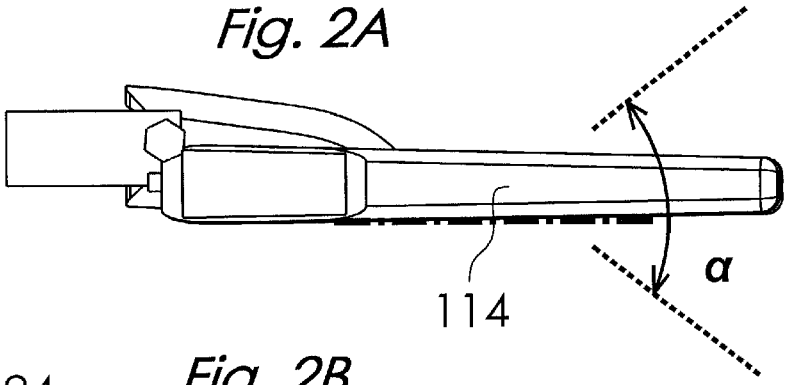
FIG. 2A is a side view of the swim fin shown in FIG. 1
Figure 2B:
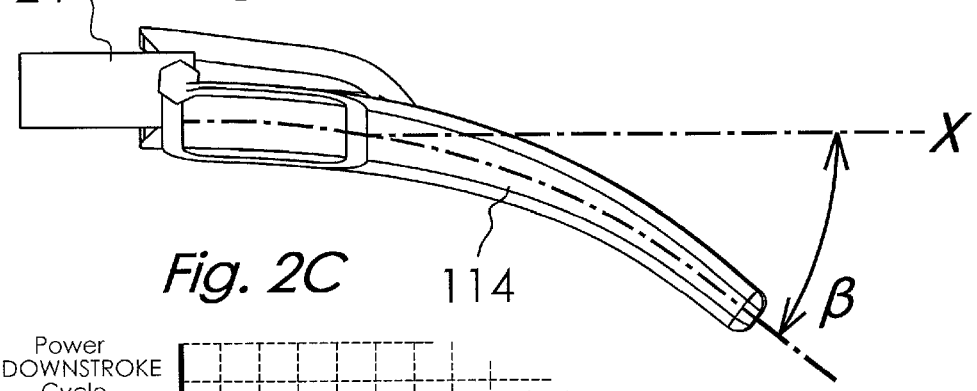
FIG. 2B is a side view of the swim fin shown in FIG. 1 illustrating an attack angle position of the swim fin blade during an upstroke.
Figure 2C:
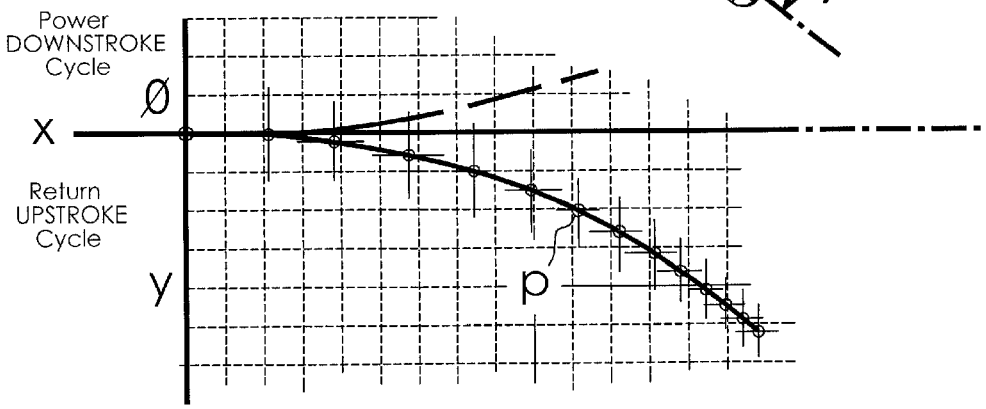
FIG. 2C is a x-y coordinate graph illustrating an angle of attack of the swim fin shown in FIG. 1 during a power down stroke kicking cycle and a return up stroke kicking cycle.
Figure 3A:
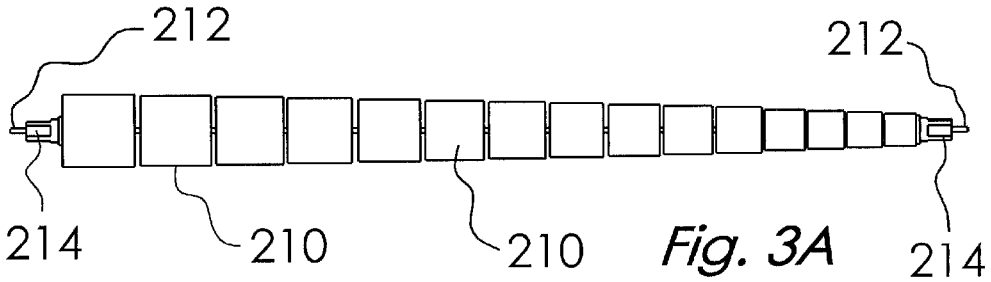
FIGS. 3A-3D are perspective views of a second embodiment of a swim fin spine.
Figure 3B:
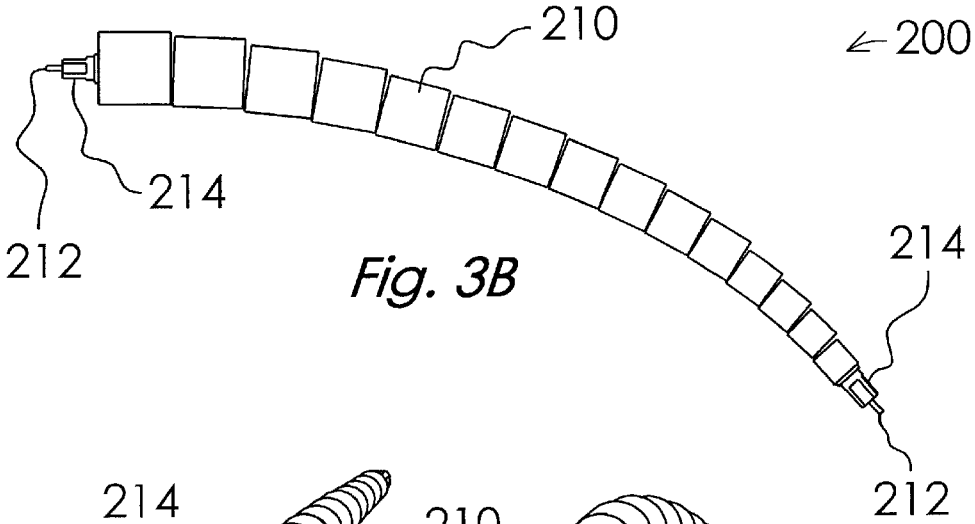
Figure 3C:
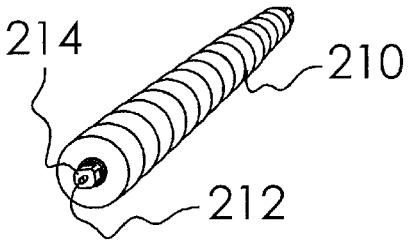
Figure 3D:
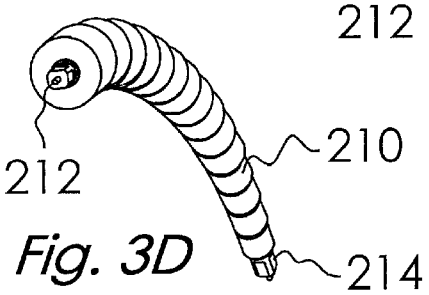

Referring now to FIGS. 2A-2C, a maximum angle of attack a of the fin blade 112 is illustrated. As discussed above, the column of blocks 118 constrain the fin blade 112 and the fin rails 114 to flex or bend within the predetermined angular range a. As water pressure is applied against the fin blade 112 by the swimmer kicking, the fin blade 112 and fin rails 114 flex about the flex region 116, first in one direction and then the other with the swimmer's upward and downward kicking strokes. Flexing of the fin rails 114 forces compression of the column of blocks 118 until the predetermined maximum flex angle or angle of attack is reached. A reverse flex angle occurs during the return kick stroke. Engagement or contact of the blocks 118 with each other under compression prevents further flexing of the fin blade 112 and fin rails 114 beyond the predetermined maximum angle of attack.

Referring to the graph in FIG. 2C, each data point 'p' represents the approximate position in an x-y coordinate graph of the center of mass of each block 118 during a kick cycle. In this instance the data points 'p' are taken when the maximum column length of the blocks 118 occurs during the return upward kick stroke, where typically the hydrodynamic attack angle is less as compared to the power down kick stroke.

Directing attention now to FIGS. 3A-3D, a second embodiment of an articulating swim fin spine is generally identified by the reference numeral 200. As evidenced by the use of common reference numerals, the swim fin spine 200 is similar to the swim fin spine 117 described above with the exception that the swim fin spine 200 may include a column of bushings 210 arranged in succession on a flexible cable 212 routed through the center of each bushing 210. The bushings 210 may be captured between cable lugs 214 crimped on the opposite distal ends of the cable 212. The cable 212 may be stainless steel cable, although galvanized cable may be satisfactory, particularly for use of the swim fin in fresh water and/or when the column of bushings 210 is sealed within the swim fin rails 114. The cable 212 includes sufficient tensile strength for the tension forces that may be applied to the cable 212 during flexing of the fin blade 112 and the fin rails 114, typically ranging from 5-275 pounds per inch. The bushings 210 may be constructed of plastic or metal, preferably of acetal or polycarbonate. In instances where the fin blade 112 is sufficiently large, the swim fin spine 200 may be integrated within the fin blade material and extend between and substantially parallel to the fin rails 114 at the lateral edges of the fin blade 112.

Figures 4, 5, 6:
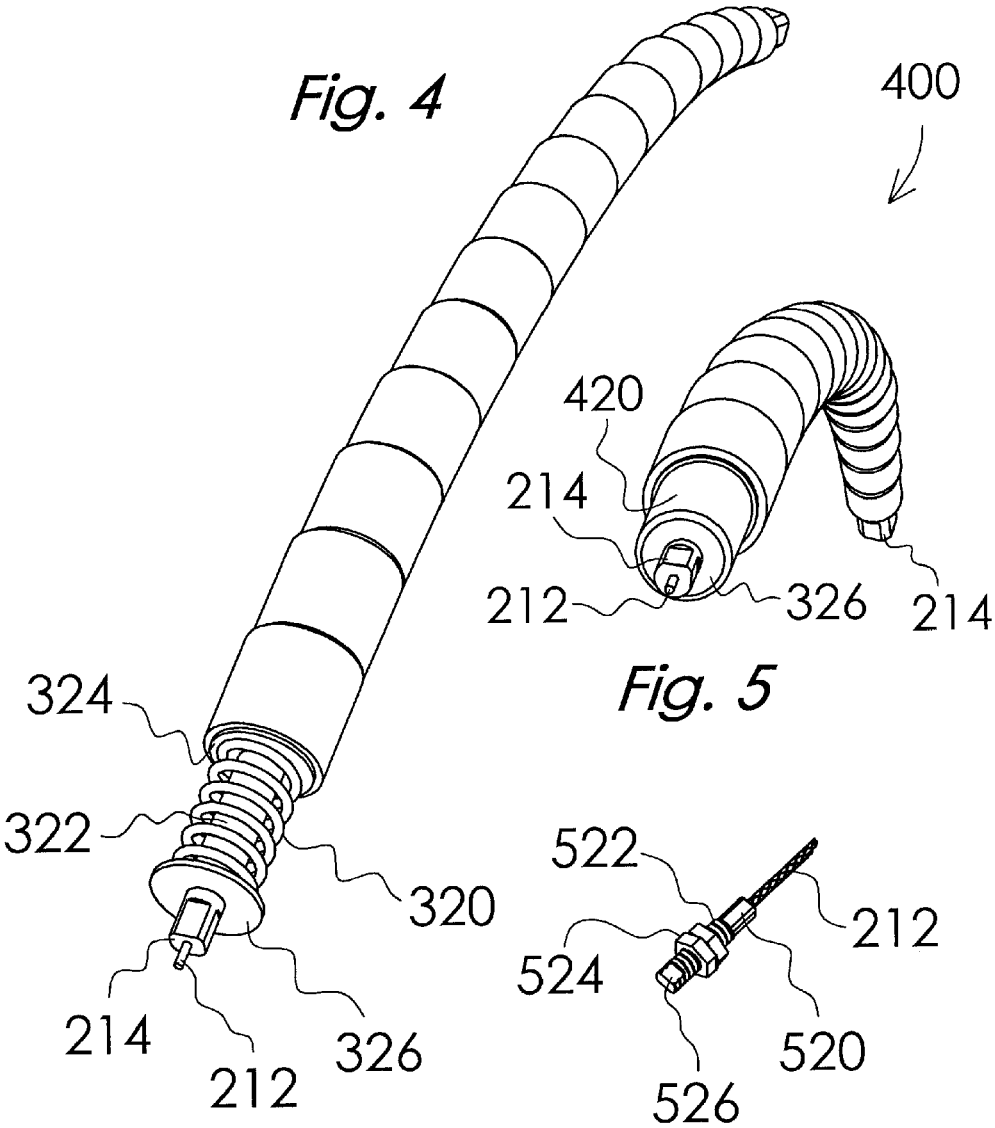
FIG. 4 is a perspective view of a third embodiment of a swim fin spine.
FIG. 5 is a perspective view of a fourth embodiment of a swim fin spine.
FIG. 6 is a partial perspective view of a fifth embodiment of a swim fin spine.
Figure 7A:
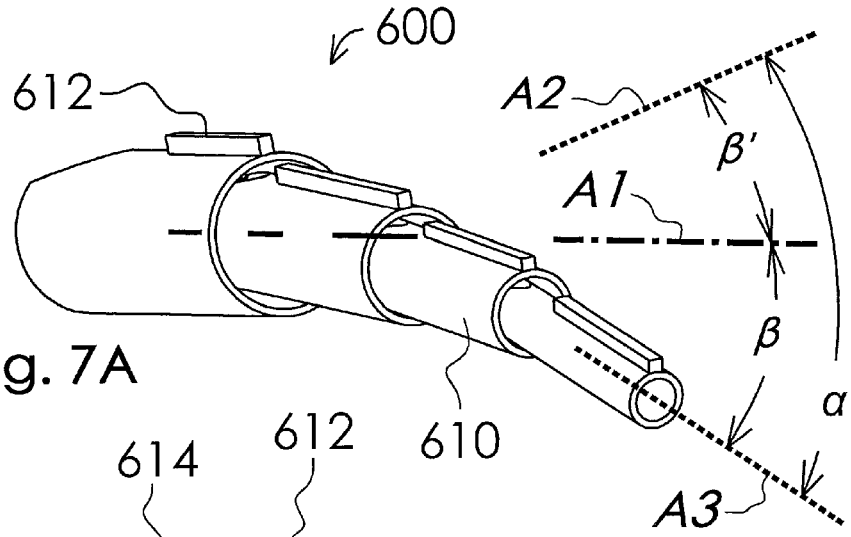
FIGS. 7A-7D are perspective views of a sixth embodiment of a swim fin spine.
Figure 7B:
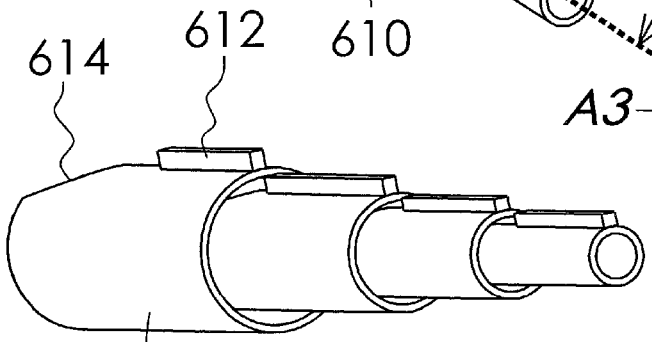
Figure 7C:
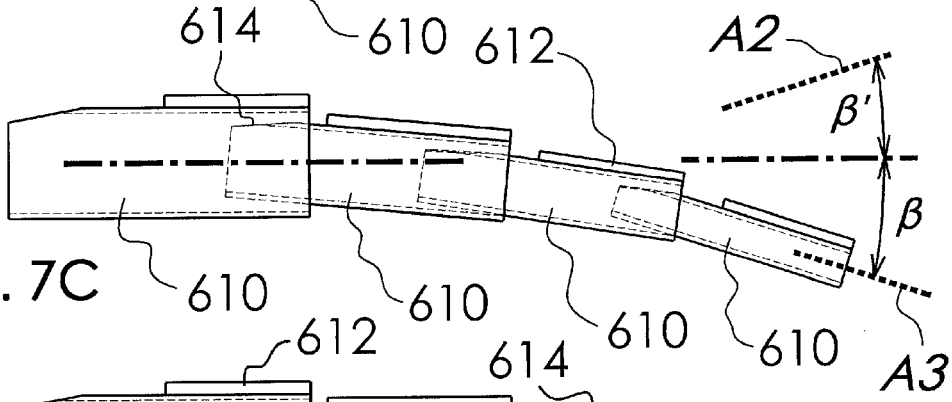
Figure 7D:
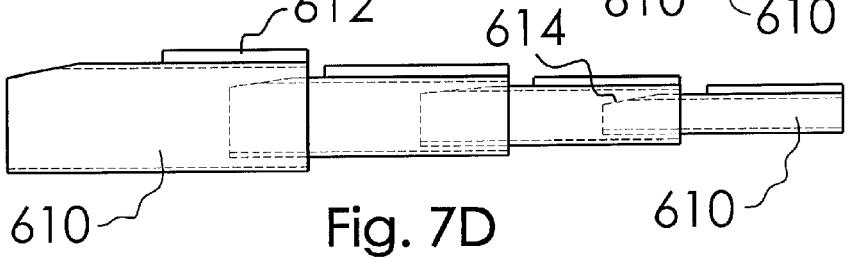
Figures 8A, 8B, 8C, 8D, 8E:
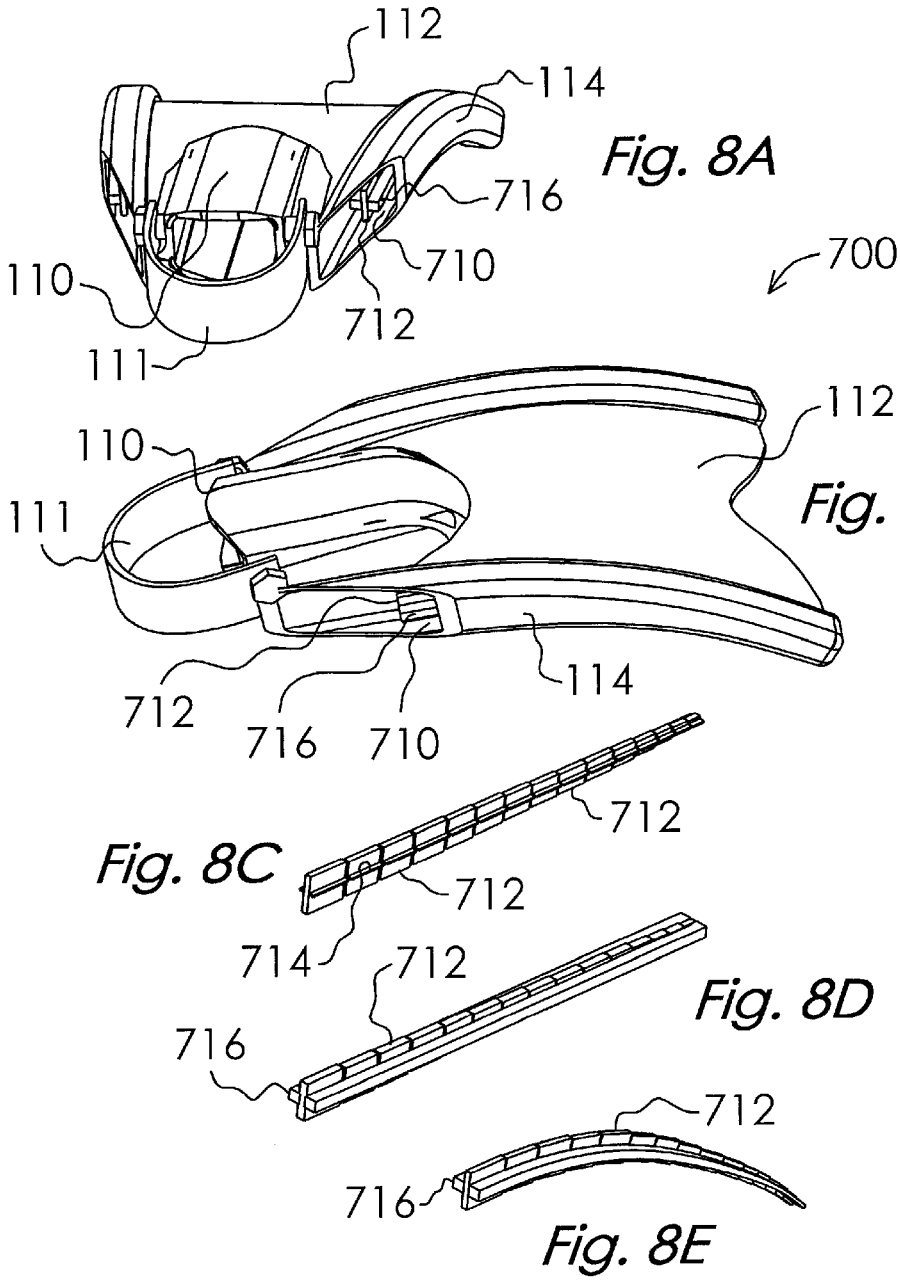
FIGS. 8A-8E are perspective views of a seventh embodiment of a swim fin and a swim fin spine.

Referring now to FIG. 4, a third embodiment of an articulating swim fin spine is generally identified by the reference numeral 300. As evidenced by the use of common reference numerals, the swim fin spine 300 is similar to the swim fin spine 200 described above with the exception that the swim fin spine 300 may include a compression spring 320, a spring centering bushing 322 and spring washers 324 and 326. For fin spine 300, the characteristics of blade deflection as a function of thrust force may be incorporated in an adjustable manner into the swim fin design for a desired absolute maximum deflection profile of the fin blade 112, as shown in FIGS. 2A-2C. For example, the spring 320 may have a spring constant of 800 pounds per inch of deflection (K=800 lb/in), with an initial and installed spring deflection of zero inches, and where the spring 320 may be compressed or deflected to a maximum of 0.34 inches during a kick stroke cycle.

Referring next to FIG. 5, a fourth embodiment of an articulating swim fin spine is generally identified by the reference numeral 400. As evidenced by the use of common reference numerals, the swim fin spine 400 is similar to the swim fin spine 300 described above with the exception that the swim fin spine 400 may include a urethane compression spring 420 of the type used for die stamping operations, instead of a compression spring 320. The urethane compression spring 420 may be sized appropriately for use in the swim fin spine 400. Typically, urethane die stamping springs successfully perform over millions of cycles. In an example with similar force characteristics as the metal compression spring 320 above, it is estimated the urethane compression spring 420 may be ⅝ inch in diameter and 1 inch in height, with a 0.20 inch hole, and require 250 pounds of force to deflect ¼ inch.

Referring now to FIG. 6, in a fifth embodiment of a swim fin spine, a fitting 520 may be swaged to a distal end of the cable 212. The fitting 520 may include a threaded portion 522. Lock nuts 524 may be threaded on the fitting 520 for adjusting the tension in the cable 212. The fitting 520 may include fitting flats 526 at the distal end thereof for conveniently holding the fitting 520 while threading and locking the locking nuts 524 to achieve a desired tension in the cable 212.

Referring next to FIGS. 7A-7D, in a sixth embodiment of a swim fin, an articulating swim fin spine 600 may comprise a series of tubes 610. The fin spine 600 may be molded in the fin rails 114 of a swim fin similar to the arrangement of the blocks 118 described above with reference to the swim fin 100. The tubes 610 may have reducing diameters for successively nesting within each other. The number of tubes 610 may vary depending on the swim fin maximum angle of attack.

The tubes 610 may include a rib 612 projecting from the outer surface thereof for restricting tube rotation. Axial misalignment of the telescoping tubes 610 permits the fin blade 112 to flex within an attack angle range defined by angle α, shown in FIG. 7A. The tubes 610 may include a tube chamfer 614 on one side thereof for unsymmetrical flexing of the fin blade 112. A greater angle of attack range may be generated at the side of the tubes 610 opposite the chamfer 614, identified as angle β in FIGS. 7A and 7C. A smaller angle of attack range is shown as angle β' in FIG. 7A, where line A1 represents a straight relaxed swim fin profile, line A2 is the stop limit or maximum angle of attack of a kick cycle down stroke and line A3 is the stop limit or maximum angle of attack of a kick cycle up stroke.

Referring next to FIGS. 8A-8E, a seventh embodiment of a swim fin is generally identified by the reference numeral 700. As evidenced by the use of common reference numerals, the swim fin 700 is similar to the swim fin 100 described above with the exception that the swim fin 700 may include a rail cavity 710 for receipt of a column of blocks 712 therein. The open end of the cavity 710 may be closed by a plug, cap or seal (not shown in the drawings). The cavity 710 may be tapered toward the forward end of the fin rails 114 or may be uniform in cross section the entire length of the cavity 710.

The blocks 712 may be plastic or metal and each block 712 may include ribs 714 projecting outwardly in opposite directions from the sides of the blocks 712. The blocks 712 may decrease in size toward the forward end of the column to be received in a tapered cavity 710. The blocks 712 may be connected with flashing (unillustrated) similar to the blocks 118 described above with reference to swim fin 100. Alternatively, an elastomer 716 may be molded or glued to the sides of the blocks 712 and/or the side ribs 714 prior to being molded in place or secured in the rail cavities 710.

Referring next to FIGS. 9A-9D, an eighth embodiment of an articulating spine for a swim fin is generally identified by the reference numeral 800. The spine 800 may be easily adjusted without the need for tools. The spine 800 may include a longitudinal cable 810 and a plurality of bushings 812 threaded on the cable 810. A lug 814 crimped on a distal end of the cable 810 provides a stop shoulder for the bushings 812. The cable 810 may be manufactured of any suitable material having sufficient tensile properties. Aircraft cable or stainless steel cable is preferred.

During assembly of the spine 800 an end fitting 816 may be fixedly secured, by crimping or other suitable method known in the art, to an end portion of the cable 810 extending beyond the bushings 812 threaded thereon. The end fitting 816 may include a threaded portion 818 for threaded engagement by an adjustment knob 820. The knob 820 may be tightened to compress the bushings 812 to affect the tension in the cable 810 and change the flexibility of the spine 800. A washer (not shown in the drawings) may be included between the knob 820 and the bushings 812 to better distribute compression forces at the interface between the knob 820 and the bushings 812. A metal compression spring or urethane compression spring may be included at any point along the spine 800 to effect flex characteristics of the spine 800 and limit potential damage to the bushings 812 in the event extreme flexing conditions are encountered. The bushings 812 may be fabricated from metal or plastic materials.

Figures 9A, 9B, 9C:
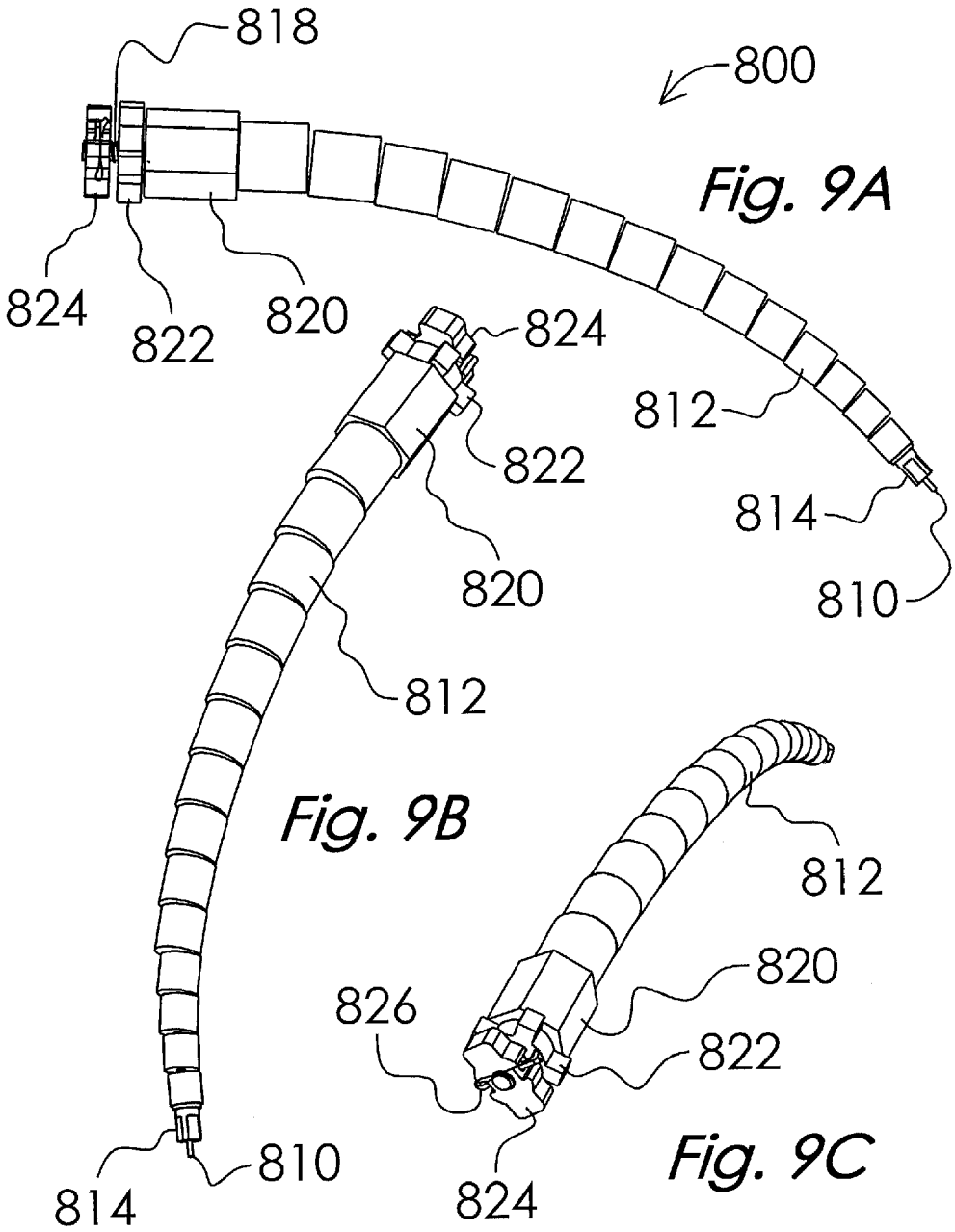
FIGS. 9A-9C are perspective views of an eighth embodiment of a swim fin spine.
Figure 9D:
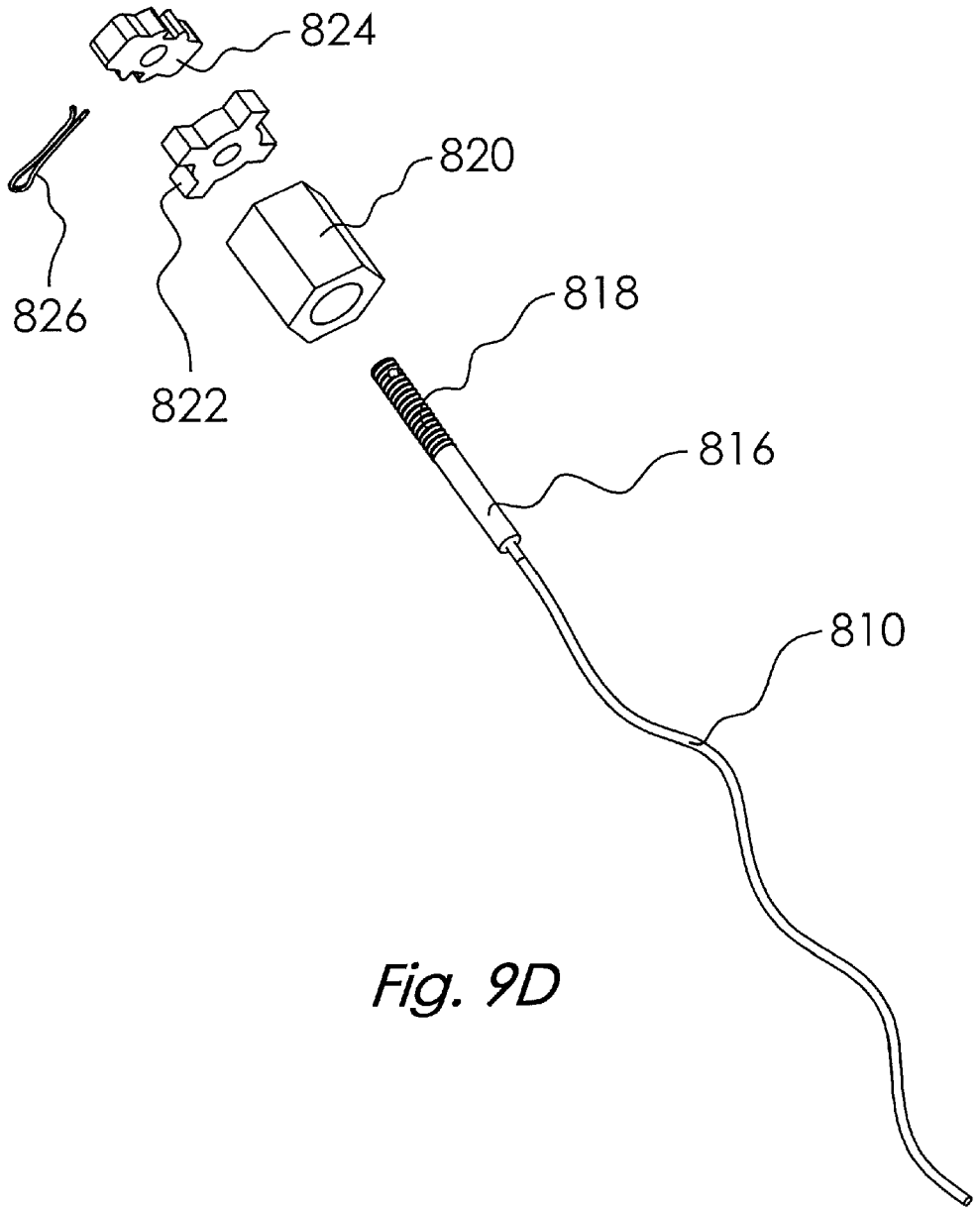
FIG. 9D is an exploded partial perspective view of the swim fin spine shown in FIGS. 9A-9C.
Figures 10A, 10B, 10C, 10D:
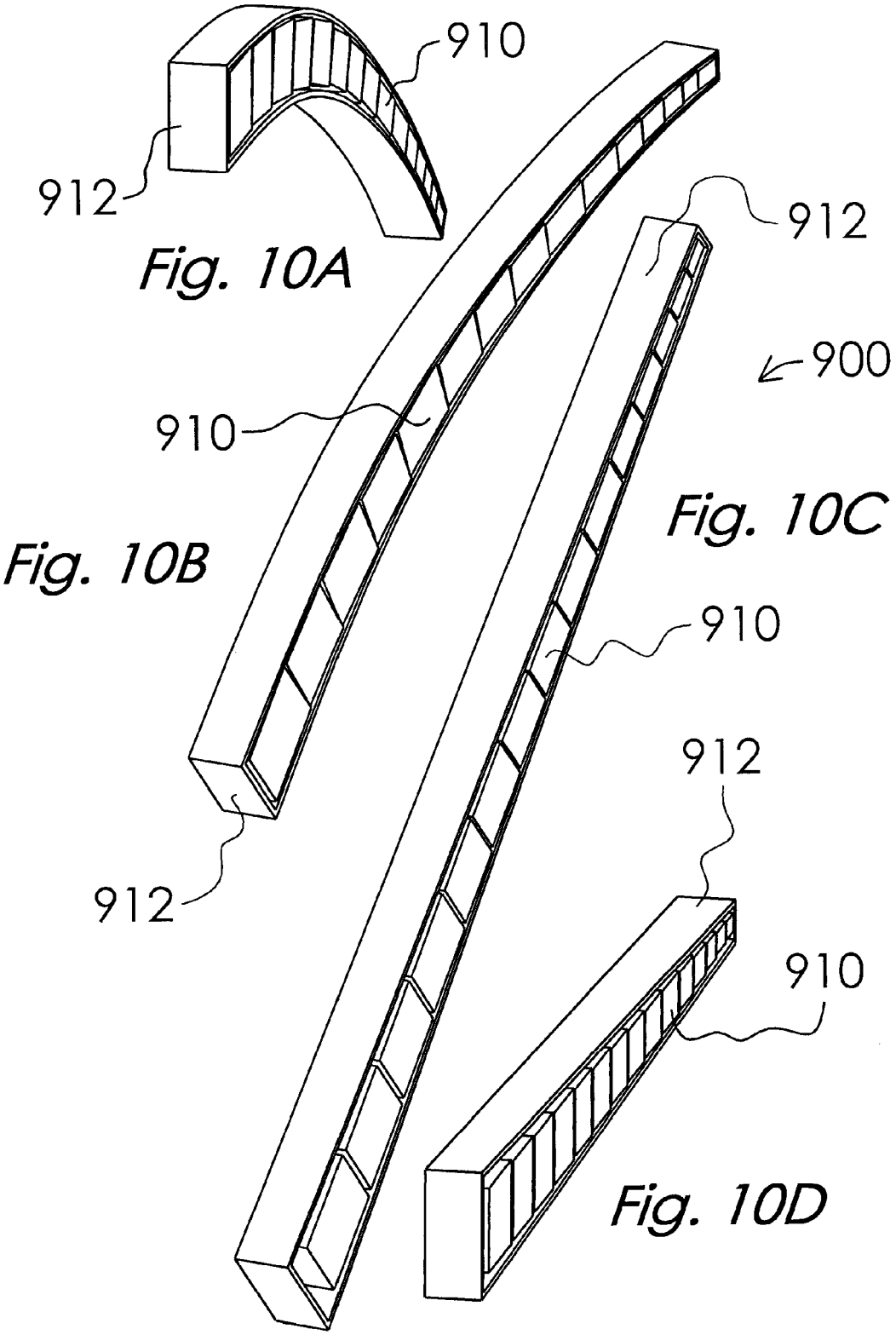
FIGS. 10A-10D are perspective views of a ninth embodiment of a swim fin spine.
Figures 11A, 11B, 11C, 11D, 11E:
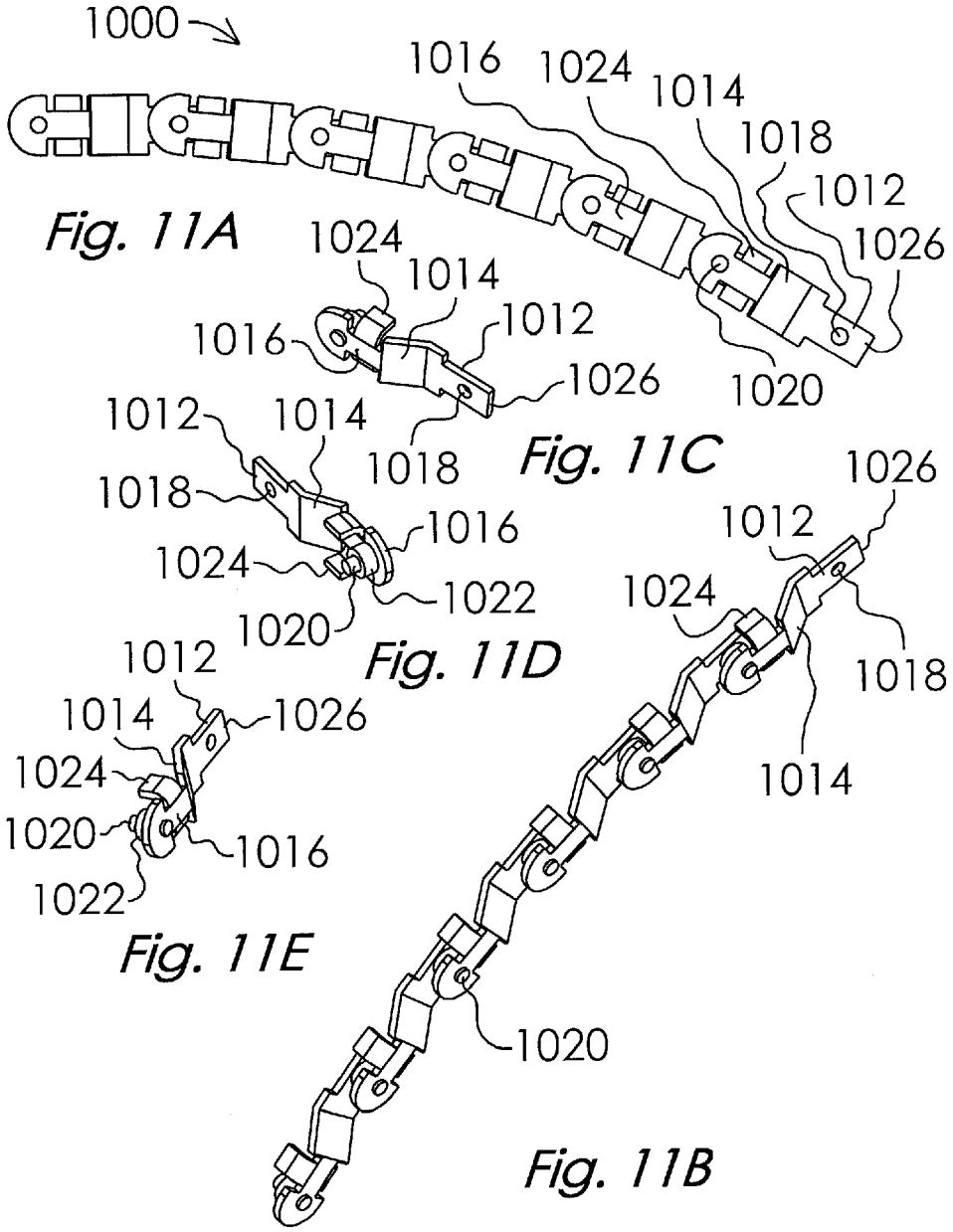
FIGS. 11A-11E are perspective views of a tenth embodiment of a swim fin spine.

Referring now specifically to FIG. 9D, upon adjustment of the knob 820 to effect a predetermined tension in the cable 810, a locking nut 822 may be threaded on the fitting 816 and tightened against the knob 820 to prevent inadvertent untightening of the knob 820. A thumb grip 824 may be secured to the fitting 816 with a cotter pin 826 and the like. The thumb grip 824 may be grasped to prevent the cable 810 from rotating while the knob 820 is rotated to change the tension force applied to the spine 800. The spine 800 may be integrally installed with the fin blade 112 or installed in the cavity 710 of the fin rails 114.

Directing attention now to FIGS. 10A-10D, a ninth embodiment of a swim fin spine is generally identified by the reference numeral 900. As evidenced by the use of common reference numerals, the swim fin spine 900 is similar to the swim fin spine 117 described above with reference to swim fin 100. The spine 900 may include blocks 910 arranged in a serial or linear manner and captured within a perimeter band 912. The band 912 may be plastic or metal. In the instance where the band 912 is metal, overlapping distal ends of the band 912 may be joined together by a conventional connector (not shown in the drawings), such as a clip that may be crimped about the overlapping ends of the band 912.

As described above in greater detail, flexing of the fin blade 112 and fin rails 114 forces compression of the column of blocks 910 until the predetermined maximum angle of attack is reached. A reverse flex angle occurs during the return kick stroke. Engagement or contact of the blocks 910 under compression prevents further flexing of the fin blade 112 and rails 114 beyond the predetermined maximum angle of attack.

Referring now to FIGS. 11A-11E, a tenth embodiment of an articulating swim fin spine is generally identified by the reference numeral 1000. The spine 1000 may include a plurality of stamped links 1010 pivotly connected to one another. The links 1010 may include a first segment 1012, a second segment 1014 extending angularly from the first segment 1012 and a third segment 1016 extending from the second segment 1014. The first segment 1012 and third segment 1016 are laterally offset and are substantially parallel to one another.

The first segment 1012 may include a hole 1018 and the third segment 1016 may include an upstanding post 1020. A substantially U-shaped tab 1024 may be fixedly secured to the third segment 1016. The tab 1024 may be inwardly offset from the post 1022 toward the second segment 1014. Upon assembly of the links 1010 to form the spine 1000, the links 1010 are arranged end to end with the post 1020 of one link 1010 extending through the hole 1018 of an adjacent link 1010. Washers 1022 may be journaled about the post 1020 as needed to aid the rotation of one link 1010 relative to another. When the links 1010 are connected to form the spine 1000, a distal end 1026 of the first segment 1012 of a link 1010 extends between the spaced apart arms of the U-shaped tab 1024 of the adjacent link 1010. During a kicking stroke, flexing of the fin rails 114 rotates the first segment 1012 of the links 1010 about the post 1020 of an adjacent link 1010, and thereby moves the distal end 1026 of a link 1010 into contact with the upper or lower arms of the tab 1024 of an adjacent link 1010. The upper and lower limits of the maximum angle of attack are defined by the distance of the tab arms from the center point of the U-shaped tabs 1024. Equidistant spacing of the tabs 1024 arms produces symmetrical flexing of the spine 1000 in both kicking directions, while unequal spacing of the tabs 1024 arms from the center point produces unsymmetrical flexing of the spine 1000.

Figures 12A, 12B:
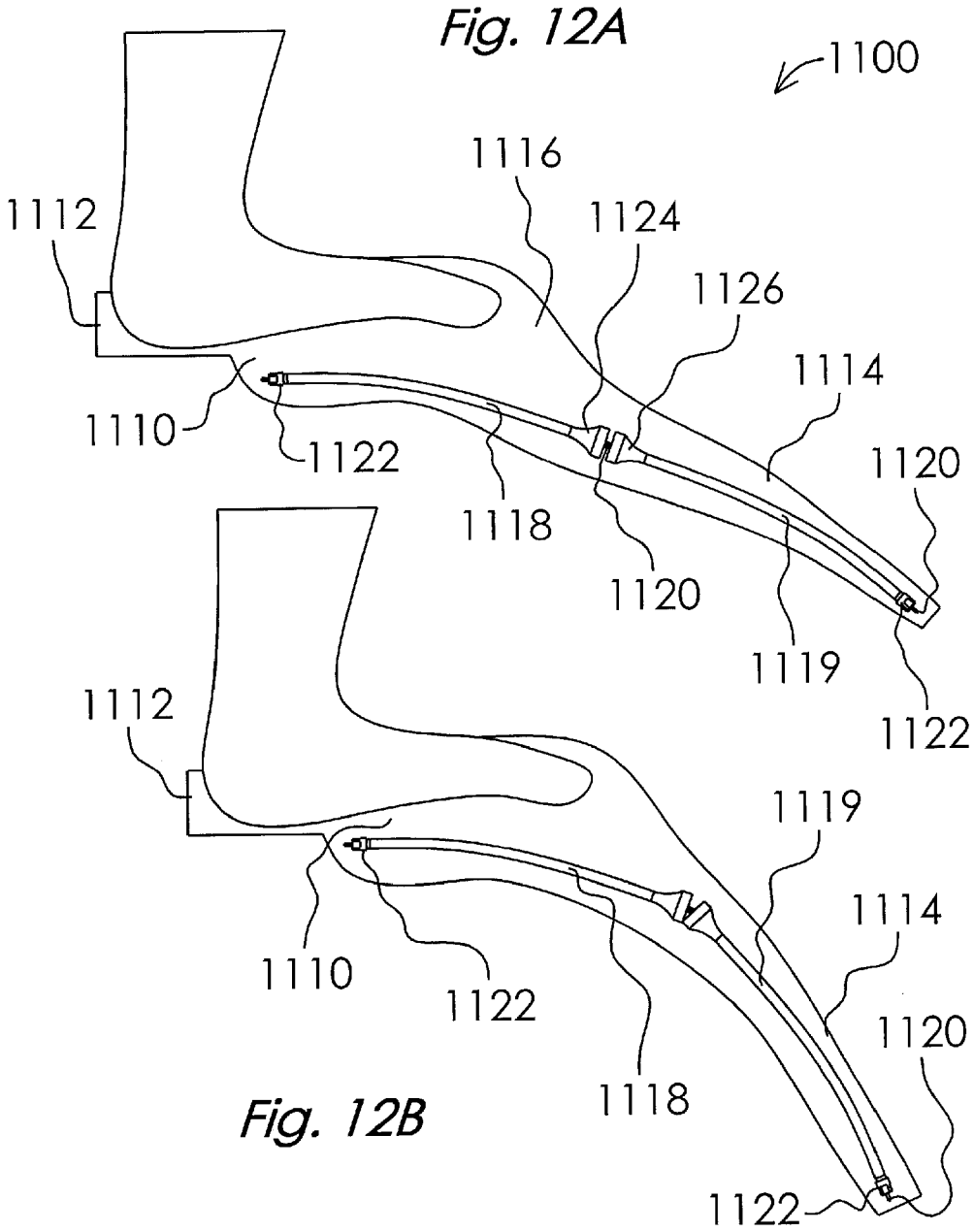
FIGS. 12A-12B are perspective views of an eleventh embodiment of a swim fin and a swim fin spine.
Figure 13A:
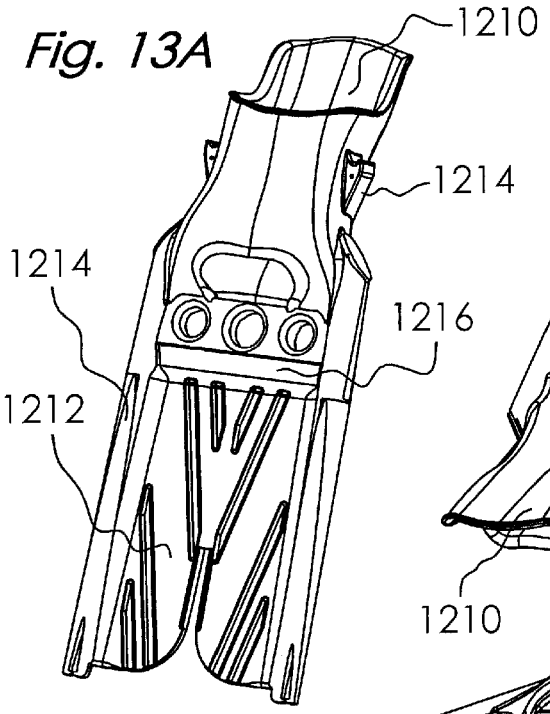
FIGS. 13A-13C are perspective views of a twelfth embodiment of a swim fin and a swim fin spine.
Figure 13B:
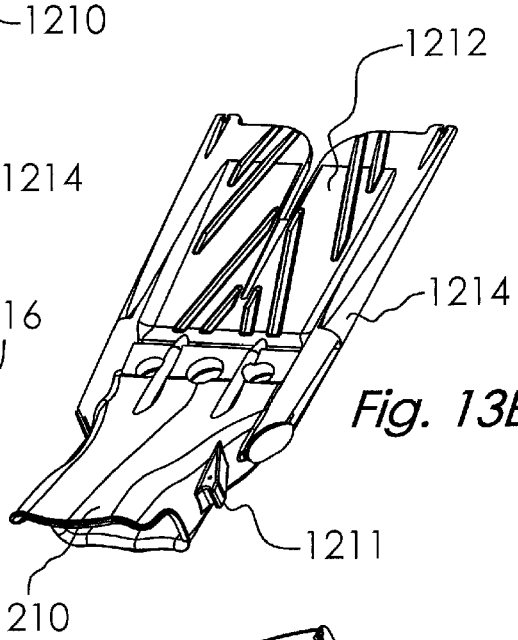
Figure 13C:
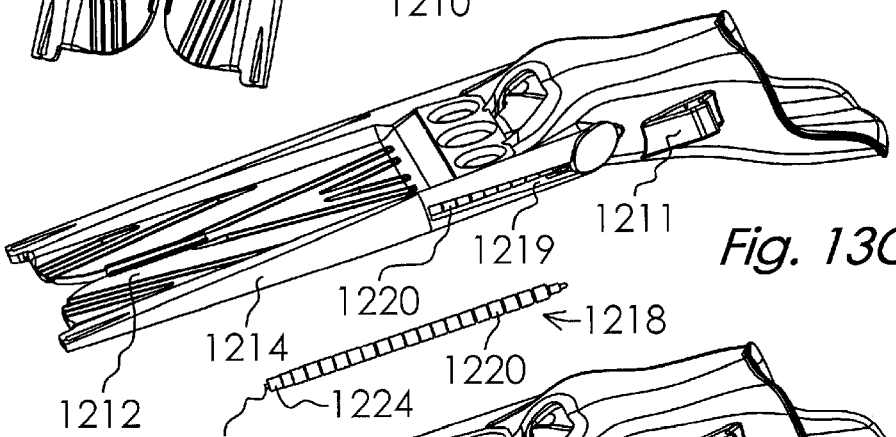
Figure 13D:
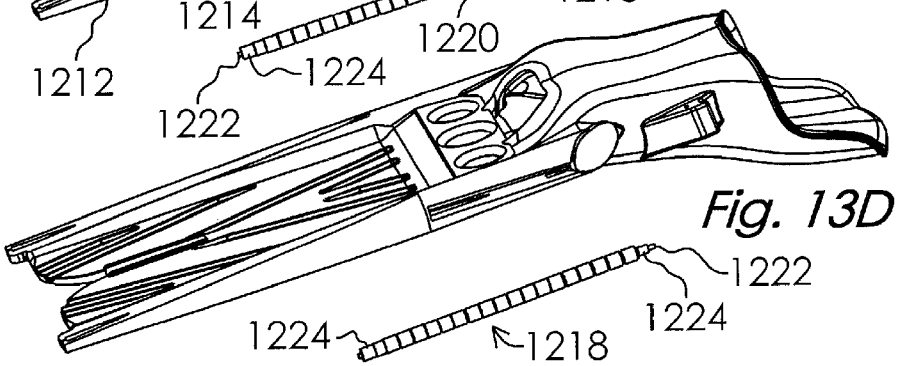
FIG. 13D is an exploded perspective view of the swim fin and swim fin spine shown in FIGS. 13A-13C.

Referring next to FIGS. 12A and 12B, an eleventh embodiment of a swim fin is generally identified by the reference numeral 1100. The swim fin 1100 may be formed of a flexible material, such as rubber, thermoplastic rubber and/or other synthetic material. and/or a composite of materials including carbon fiber. The swim fin 1100 may include a full boot or shoe for receiving the foot of a swimmer or an open foot pocket 1110. A heel strap 1112 may be provided to secure the foot of a swimmer in the foot pocket 1110. A fin blade 1114 may extend from the foot pocket 1110 defining a substantially planar surface for channeling water flow across the swim fin 1100.

The fin blade 1114 may be relatively stiff. During a kicking cycle, the fin blade 1114 may flex about a transverse hinge region 1116 of the swim fin 1100. At least two elongated members 1118 and 1119 that pivot relative to one another may be molded in the swim fin 1100. The members 1118, 1119 are longitudinally aligned and may extend from the foot pocket 1110 to proximate the distal end of the fin blade 1114. A cable 1120 may be routed through the members 1118, 1119 which are captured between lugs 1122 crimped at both terminal ends of the cable 1120.

The members 1118, 1119 may include opposed abutment heads 1124 and 1126, respectively. Upon flexing of the fin blade 1114, the heads 1124, 1126 are forced against each other and thereby limit further flexing of the fin blade 1114. The maximum angle of attack of the fin blade 1114 is limited in the manner described above with reference to the swim blade 100.

Referring now to FIGS. 13A-13D, a twelfth embodiment of a swim fin is generally identified by the reference numeral 1200. The swim fin 1200 may include a full boot or shoe for receiving the foot of a swimmer or an open foot pocket 1210. A heel strap (not shown in the drawings) may be provided to secure the foot of a swimmer in the foot pocket 1210. The heel strap may clip into strap anchors 1211 attached at each side of the foot pocket 1210. A fin blade 1212 may extend from the foot pocket 1210, defining a substantially planar surface for channeling water flow across the swim fin 1200. Fin rails 1214 may extend along the lateral edges of the fin blade 1212.

The foot pocket 1210, fin blade 1212 and fin rails 1214 may be molded as one piece. The material of the foot pocket 1210 may be flexible but the fin blade 1212 is relatively stiff. During a kicking cycle, the fin blade 1212 may flex about a transverse hinge region 1216 of the swim fin 1200. Flexing of the fin blade 1212 may be limited by swim fin spines 1218 disposed at the lateral edges of the hinge region 1216. The spines 1218 may be molded in place or inserted in an elongated cavity 1219 formed along the lateral edges of the hinge region 1216.

The fin spines 1218 may include a column of bushings 1220 threaded on a flexible cable 1222 routed through the center of each bushing 1220. The bushings 1220 may be captured between cable lugs 1224 crimped on the opposite distal ends of the cable 1222. The spines 1218 are relatively short compared to the fin spines 117 described above with reference to FIG. 1, and are permitted limited angular flexing. An advantage of the short fin spines 1218 is a reduction in material costs and weight of the metal bushings.

While various embodiments of the invention has been shown and described, other and further embodiments of the invention may be devised without departing from the basic scope thereof, and the scope thereof is determined by the claims which follow.

The invention claimed is:

1. A swim fin comprising:

a) a flexible body including a foot pocket adapted to receive a foot of swimmer;

b) a substantially stiff fin blade extending outwardly from said foot pocket, said fin blade including a substantially flat surface between laterally spaced edges;

c) fin rails extending along said laterally spaced edges of said fin blade; and d) wherein each said fin rails include a plurality of blocks in linear configuration defining a longitudinal fin spine terminating proximate a distal end of each said fin rails.

2. The swim fin of claim 1 wherein said plurality of blocks are embedded in said fin rails.

3. The swim fin of claim 1 wherein each said fin rails include a longitudinal cavity housing said plurality of blocks.

4. The swim fin of claim 3 wherein said plurality of blocks comprise a plurality of bushings in linear configuration threaded on a flexible cable, and wherein said plurality of bushings are captured between locking lugs fixedly secured at opposite distal ends of said cable.

5. The swim fin of claim 4 including a threaded fitting fixedly secured to one of said distal ends of said cable, and a lock nut threaded on said fitting for tensioning said cable to a predetermined value.

6. The swim fin of claim 3 wherein said plurality of blocks are threaded on a cable, said plurality of blocks being captured between a first locking nut fixedly secured at a distal end of said cable and second locking nut fixedly secured at a proximal end of said cable, and including a compression spring journaled about said cable disposed between said second locking nut and said plurality of blocks.

7. The swim fin of claim 6 wherein said compression spring comprises a urethane compression spring.

8. The swim fin of claim 1 wherein said plurality of blocks comprise a plurality of tubes having successively reduced diameters, said plurality of tubes arranged in a partially telescoping configuration.

9. The swim fin of claim 8 wherein each said plurality of tubes includes a surface forming a tube chamfer proximate a distal end of each said plurality of tubes.

10. The swim fin of claim 3 including rib members projecting outwardly from opposite sides of each said plurality of blocks.

11. The swim fin of claim 3 wherein said longitudinal cavity tapers inwardly toward a forward end of said fin rails.

12. The swim fin of claim 5 including a tension adjusting knob threaded on said fitting.

13. The swim fin of claim 3 including a band extending about a longitudinal perimeter defined by said plurality of blocks.

14. The swim fin of claim 1 wherein said plurality of blocks comprise a plurality of links pivotally connected in linear configuration.

15. The swim fin of claim 14 wherein each said plurality of links include a first segment, a second segment and a third segment, said first segment being substantially parallel and laterally offset from said third segment.

* * * * *